United States Patent [19]

Orlov et al.

[11] 4,205,489

[45] Jun. 3, 1980

[54] APPARATUS FOR FINISHING WORKPIECES ON SURFACE-LAPPING MACHINES

[76] Inventors: Petr N. Orlov, Leninsky prospekt, 152, kv. 177; Ivan A. Loginov, 103489, korpus 405, kv. 148; Vladimir E. Beiden, ploschad Junosti, 4, kv. 2; Boris S. Smolyaninov, Berezovaya alleya, 1, kv. 39; Anatoly S. Balabanov, 103489, korpus 621, kv. 28; Vladimir V. Scherbakov, Bolshevistsky pereulok, 13/3, kv. 8; Anatoly V. Chamov, 103498, korpus 442, kv. 110; Konstantin F. Skvortsov, ulitsa Nedelina, 34, korpus 1, kv. 134; Alexandr S. Chizhov, Simonovsky val, 8, kv. 20, all of Moscow; Mukim M. Khasanov, ulitsa Sviridenko, 1 proezd, 10/1, kv. 5; Valery A. Peshkov, ulitsa Fedina, 2, kv. 19, both of Dushanbe, all of U.S.S.R.

[21] Appl. No.: 858,896

[22] Filed: Dec. 8, 1977

[30] Foreign Application Priority Data

Dec. 10, 1976 [SU] U.S.S.R. ..... 2425203
Feb. 25, 1977 [SU] U.S.S.R. ..... 2452301

[51] Int. Cl.[2] ..... B24B 7/04
[52] U.S. Cl. ..... 51/118
[58] Field of Search ..... 51/111 R, 117, 118, 51/119, 120, 113, 161

[56] References Cited

U.S. PATENT DOCUMENTS

| | | | |
|---|---|---|---|
| 1,208,278 | 12/1916 | Blecher | 51/120 |
| 1,509,823 | 9/1924 | Blood | 51/161 |
| 1,610,527 | 12/1926 | Indge | 51/117 |
| 1,937,459 | 11/1933 | Hill | 51/111 R |
| 1,963,884 | 6/1934 | Budd | 51/118 |
| 1,972,086 | 9/1934 | Buckley | 51/120 |
| 2,518,501 | 8/1950 | Snyder | 51/118 |
| 2,668,397 | 2/1954 | Holzricher | 51/161 |
| 3,380,198 | 4/1968 | Takada | 51/111 R |

FOREIGN PATENT DOCUMENTS

| | | | |
|---|---|---|---|
| 416652 | 7/1925 | Fed. Rep. of Germany | 51/120 |
| 241052 | 6/1946 | Switzerland | 51/120 |
| 483229 | 9/1975 | U.S.S.R. . | |

*Primary Examiner*—Harold D. Whitehead
*Assistant Examiner*—K. Bradford Adolphson
*Attorney, Agent, or Firm*—Robert E. Burns; Emmanuel J. Lobato; Bruce L. Adams

[57] ABSTRACT

Apparatus for changing the rotation speed of a workpiece holder axle relative to the axle of a drive shaft, the tangential acceleration of this movement, and the pressure between the surface of workpieces and lapping tools. These changes are set cyclically, directly in the apparatus for finishing. The machines for the realization of such control of the finishing process are equipped with units which are capable of regulating the value of the complex eccentricity of holder rotation and have independent drive systems for adjusting the kinematic factors in the course of finishing. This ensures uniform abrasion over the entire working surface of the lapping tools.

2 Claims, 9 Drawing Figures

APPARATUS FOR FINISHING WORKPIECES ON SURFACE-LAPPING MACHINES

BACKGROUND OF THE INVENTION

The present invention relates to an apparatus for surface-machining of workpieces made of hard-to-work materials and can be utilized in many branches of a country's economy for machining workpieces of steel, ceramics, hard alloys, quartz, ruby, silicon, saphire, glass, etc.

More particularly, the present invention relates to an apparatus for finishing workpieces with free abrasive on a surface-lapping machine.

According to the known apparatus for finishing workpieces the lapping tools are dressed kinematically directly in the process of lapping by the same workpieces being machined which is effected due to a special cyclic change in the value and direction of the rotation speeds of the operating elements of the finishing machine.

A disadvantage of this known apparatus consists in that during prolonged operation the lapping tools become mutually "worn-in" which increases the amount of required labour considerably and impairs the effectiveness of kinematic dressing. The "wearing-in" phenomenon with regard to the lapping tools is characterized by two features.

Firstly, the profile of the lapping tool acquires a definite shape of the worn working surface differing from the initial shape. In this case, when the workpiece is finished from two sides, the profiles of the upper and lower lapping tools become mutually matching, i.e. one of them becomes a mirror image of the other.

This disadvantage is caused by the error of the apparatus in which the velocities are selected with no regard to the redistribution of pressure over the surfaces of the gradually wearing lapping tools.

Secondly, the surface layer of the lapping tools acquires a maximum wear resistance due to the redistribution of internal stresses and the formation of a dynamic equilibrium (for the given wearing conditions at the given working duty) between the developing microscopic cracks, removed with the products of abrasion and responsible for the intensity of shaping the surfaces of the workpiece and lapping tools.

This results in that changes in the kinematic conditions in the prior art method make difficult the finishing of workpieces with simultaneous kinematic dressing of the lapping tools, the finishing time sharply increases so that the accuracy of finishing depends on the duration of the transitional dressing period.

One of the methods of eliminating the "wearing-in" phenomenon is the cyclic change in the external pressure in order to bring the system out of equilibrium.

In practice it is possible to stabilize the accuracy of the geometric shape of the machined surfaces of parts. Throughout the process of machining after achieving the required quality of the surface layer of the machined workpieces by two radically different methods, viz., by retaining the initial geometrical shape of the working surface of the lapping tool or by finding a combination of factors of the finishing process which at any given moment of time and a given condition of the working surface of the lapping tool would ensure minimum deviations from the required shape of the surface of the workpiece and the accuracy of obtained dimensions.

Also known in the prior art are machines for finishing the workpieces located between the lapping tools in the sockets of a holder mounted on an eccentric shaft which mounts a planet pinion meshing with the sun wheel of a planetary mechanism.

This layout of the machine does not permit changing the eccentricity of holder rotation and thus changing the trajectory of the workpiece moving over the lapping tools in the process of machining, i.e. it fails to ensure finishing with simultaneous kinematic dressing of the lapping tools.

The invention disclosed in the Author's Certificate No. 483229, B24b7/22 describes a surface-lapping machine designed for grinding and polishing flat surfaces which comprises a fixed lower lapping tool, a rotating upper lapping tool, a holder fixed on a gear linked kinematically with the sun wheel of a planetary mechanism, with a pinion cage and a carrier fixed on the pinion cage axle, said axle carrying a free-mounted idler gear located between the holder gear and the sun wheel while the holder gear is installed on an additional axle passing through the carrier which rests on the pinion cage (see Author's Certificate No. 483229, Cl. B24b7/22, USSR).

The disadvantages of this machine are as follows:

Impossibility of changing the ratio of rotation speeds of the pinion cage and holder gear on changes in eccentricity.

Impossibility of changing the eccentricity in the process of machining. The eccentricity can be changed only periodically, after stopping the machine.

SUMMARY OF THE INVENTION

An object of the present invention is to provide an apparatus for finishing workpieces on a surface-lapping machine which would ensure uniform abrasion of the working surface of the lapping tool or wearing off of the workpiece.

Another object of the present invention is to provide apparatus for finishing workpieces on surface-lapping machines which would ensure the required quality of the surface layer of the workpieces.

And still another object of the present invention is to provide an apparatus for finishing workpieces on surface-lapping machines which would ensure optimization of selecting the factors of the finishing process, particularly the velocity, tangential acceleration of the relative motion of the workpiece and lapping tool, and the pressure between the workpiece and the lapping tool to satisfy the requirements of labour productivity, prime cost and quality of the finished surface.

A further object of the present invention is to provide a surface-lapping machine which would ensure effective realization of said finishing method.

And still another object of the present invention is to provide a surface-lapping machine which would not require costly alterations of design and would be reliable in service.

For solving this technical problem and for accomplishment of above-mentioned and other objects, disclosure is made herein of a method of finishing workpieces on a surface-lapping machine wherein the workpieces are placed into the sockets of a holder and the latter is rotated together with the workpieces around its own axle or axis in combination with eccentric rotation of said holder axle around the axle of the machine drive shaft; this method is characterized in that, in addition to said two types of rotation and simultaneously therewith, the holder axle is rotated around a certain misaligned and parallel axle which is eccentric relative to the drive shaft axle, the machining time "t" for the given total eccentricity "e" of rotation of the holder axle around the axle of the drive shaft being derived on the condition of uniform abrasion of the entire surface of the workpieces (lapping tool), the extent of this abrasion being derived from the formula:

$$U = \int_{t_1}^{t_2} K(V,a^{\tau},p,h,T^{o}) \cdot V \cdot d \cdot t = \text{extent of abrasion;}$$

$t_1$ and $t_2$ = time limits of integration;

$$K(V,a^{\tau},p,h,T^{o})_t = K_o(V_o,a_o^{\tau},p_o,h_o,T_o^{o}) + \frac{\partial K_o}{\partial V_o}(V_t - V_o) + \frac{\partial K_o}{\partial a_o^{\tau}}(a_t^{\tau} - a_o^{\tau}) + \frac{\partial K_o}{\partial p_o}(p_t - p_o) + \frac{\partial K_o}{\partial h_o}(h_t - h_o) + \frac{\partial K_o}{\partial T_o^{o}}(T_t^{o} - T_o^{o})$$

intensity of abrasion of the material of the lapping tool (workpieces), wherein:

$v$=velocity of relative motions of the workpiece and lapping tool within each stage of the cycle of changing the value and direction of velocities;

$a^{\tau}$=tangential acceleration of the relative motions of the workpiece and lapping tool;

p=pressure between the lapping tool and the workpiece;

h=abrasive clearance between the workpiece and the lapping tool;

T°=temperature in the machining zone.

Such a solution will permit stabilizing the process of finishing the workpieces with regard to the quality of machining in two respects, viz., to retain with time the geometrical shape of the working surface of the lapping tool or to carry out programmed machining of workpieces by changing the law of abrasion of the surfaces of the lapping tool and the workpiece with time.

According to another embodiment of the present invention disclosure is made of a method of finishing workpieces on a surface-lapping machine characterized in that in the process of finishing are changed by successive steps the following factors: velocity of the relative motion of the workpiece and lapping tool, tangential acceleration of this motion, and pressure in the zone of contact between the workpiece and the lapping tool.

Thus the process of machining is optimized with regard to quality, output and prime cost by changing the intensity of abrasion of the material of the workpiece and lapping tool at cyclic changes of the finishing conditions due to intensification of the effect of the mechanism forming microscopic failure cracks of the material of the workpiece and lapping tool.

According to one more embodiment of the invention, disclosure is made of a method of finishing workpieces characterized in that the sequence of said changes in the machining conditions is alternated, the first stage being rough-machining of the workpiece at which the velocity, tangential acceleration and pressure are increased in steps from the mean nominal values to a certain maximum then returned to said nominal values after which the workpieces are finished by increasing the velocity in steps and reducing proportionally the tangential acceleration of the relative motions of the workpieces and lapping tool.

The above-mentioned technical solution allows the output and the quality of the machined surface to be improved by combining the rough and finish machining of workpieces within a single operation without replacing the lapping tool and changing the abrasive material by selecting the sequence of changes in the pressure in the zone of contact between the workpiece and the lapping tool, in the velocity and tangential acceleration of the relative motions of the workpiece and lapping tool. According to another embodiment of the invention, disclosure is made of a surface-lapping machine for lapping the workpieces located between the lapping tools in the sockets of a holder mounted on an eccentric axle of a drive shaft and rotated around its own axle which is parallel to the axles of the drive shaft and said eccentric axle by means of a planetary mechanism characterized in that the planet pinion of the planetary mechanism is mounted on the eccentric axle of the drive shaft and has an additional eccentric axle of its own which is parallel to the above-mentioned axles and is misaligned with them, the axle carrying the holder for rotating with a summary eccentricity relative to the axle of the drive shaft.

Technical solution of the present invention allows the total eccentricity and rotation speed of the holder axle to be changed relative to the drive shaft axle in the process of machining by turning the intermediate planet pinion which has an eccentric axle mounting the holder with workpieces, around the eccentric axle of the drive shaft.

According to a further embodiment of the invention, disclosure is made of a surface-lapping machine for finishing workpieces characterized in that it has an additional planetary mechanism mounted on the hub of the planet pinion of the first planetary mechanism, and a double-slider coupling one member of which serves as the planet pinion of additional planetary mechanism while the other member is installed with a provision for rotating on an additional eccentric axle and is rigidly coupled with the holder.

This technical solution allows the speed of holder rotation about its own axle to be changed with the aid of a kinematic linkage between the holder and the additional planetary drive through the double-slider coupling which transmits rotation to the holder on changes in the eccentricity of the holder with relation to the axle of the drive shaft.

According to a still further embodiment of the invention, disclosure is made of a surface-lapping machine comprising a holder mounted on a gear which is kinematically linked with the sun wheel of a planetary mechanism, with the pinion cage and a carrier fixed on the pinion cage axle, free-mounted on which is an idler gear located between the holder gear and the sun wheel, the holder gear being installed on an additional axle passing through the carrier which rests on the pinion cage characterized in that the machine is additionally provided with a disc carrying an additional axle set coaxially with the pinion cage, and a differential mechanism one axle of which is coupled with the pinion cage while the other one is coupled by idler gears with the disc, the additional axle entering into the slot of the carrier and into the arc-shaped slot of the pinion cage.

This technical solution allows the eccentricity of the holder and lapping tool axles to be changed in the process of the finishing operation by turning the holder gear complete with the carrier relative to the pinion cage axle which is achieved when the carrier is actuated by the additional axle moving along the arc-shaped slot of the pinion cage when the rotation phase of the disc is changed by turning the body of the differential mechanism which links the motions of the disc and pinion cage.

BRIEF DESCRIPTION OF THE DRAWINGS

Now the present invention will be described in detail by way of example with reference to the accompanying drawings in which.

DESCRIPTION OF THE PREFERRED EMBODIMENTS

In the process of the finishing process the workpieces move relative to the working surfaces of the lapping tools along complicated trajectories due to the reciprocating and vibratory cyclic eccentric-planetary motion of the axle 1 (FIGS. 1, 2) of the holder 2 with simultaneous changes in the value of eccentricity "e" and rotation around the axle 1 of the holder 2 with the pieces 3 at a variable or constant speed of rotation.

Figure 1:
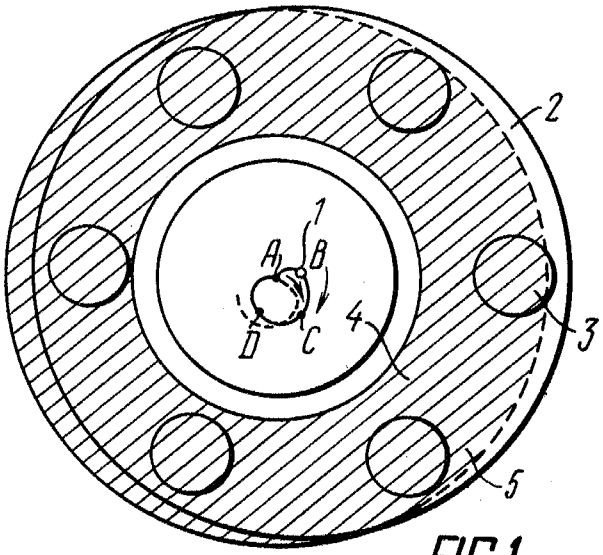
FIGS. 1 and 2 are schematic views of the eccentric machine according to the present invention, one of which shows one of the possible trajectories of the holder axle movement relative to the lapping tool axle.
Figure 2:
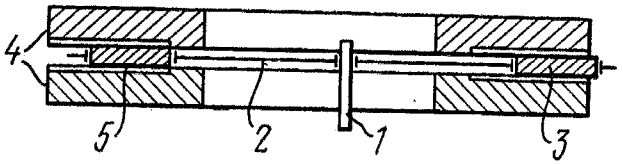

Shown in FIG. 1 is one of the possible trajectories $a_1 \ldots a_n$ ABCD of the movement of the axle 1 of the holder 2 with the workpieces 3 relative to the working surfaces of the lapping tools 4.

In this case the machining zone 5 is located on the periphery of the entire working surface of the lapping tool 4.

Figure 3A:
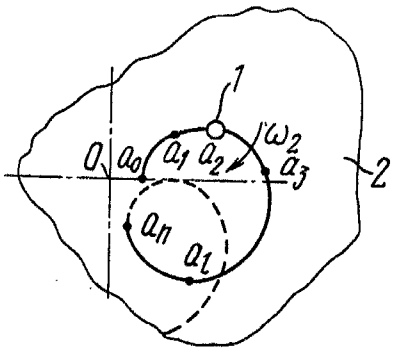
FIGS. 3*a* and 3*b* are graphs which illustrate the possible trajectories of the holder axle with relation to the lapping tool axle in the eccentric machine shown in FIGS. 1 and 2.
Figure 3B:
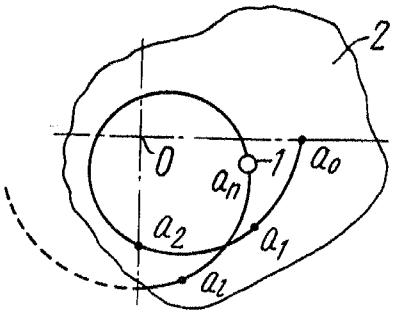

FIG. 3 shows various types of the trajectory $a_1 \ldots a_n$ of the axle 1 of the holder 2 relative to the axle of the lapping tools 4 around which the holder 2 rotates.

The vibration amplitude of the workpieces 3 over the working surfaces of the lapping tools 4 and the machining time within the limits of each zone 5 of the working surface of the lapping tools 4 are determined from the sought for condition of equality of wear of each elementary section of the lapping tool 4 or tools. The abrasion of each elementary section of the lapping tool is determined at each kinematic machining mode within the time $\Delta t = t_2 - t_1$, and is calculated by the formula:

$$U = \int_{t_1}^{t_2} K(V, a^\tau, p, h, T^o) V dt, \quad \text{(I)}$$

wherein: $K(\nu, a^\tau, p, h, T^\circ)$ = intensity of abrasion of the material of the lapping tools is the function of velocity ($\nu$) of the relative motion of the workpiece over the surface of the lapping tool, tangential acceleration ($a^\tau$), specific pressure (p) between the workpieces and the lapping tool, abrasive clearance between the workpiece and the lapping tool, i.e. the thickness of the abrasive interlayer (h), temperature in the lapping zone ($T^\circ$) and is measured in microns/mm or in $m^2$/mm. Letters $t_1$ and $t_2$ designate the time limits of integration.

The intensity of abrasion (K) is calculated by the Taylor's formula of the first-order approximation.

$$K(v, a^\tau, p, h, T^o) = K_o(v_o, a_o^\tau, p_o, h_o, T_o^o) + \frac{\partial K_o}{\partial v_o}(V_t - V_o) + \frac{\partial K_o}{\partial a^\tau}(a_t^\tau - a_o^\tau) + \frac{\partial K_o}{\partial p_o}(p_t - p_o) + \frac{\partial K_o}{\partial h_o}(h_t - h_o) + \frac{\partial K_o}{\partial T_o^o}(T_t^o - T_o^o), \quad \text{(II)}$$

wherein:

| | |
|---|---|
| $v_o$, $a_o^\tau$, $p_o$, $h_o$, $T_o^o$ $v$, $a^\tau$, $p$, $h$, $T^o$ | = corresponding values of at moments of time $t_1$, and |
| $v_t$, $a_t^\tau$, $p_t$, $h_t$, $T_t^o$ $v$, $a^\tau$, $p$, $h$, $T^o$ | = corresponding values of at a moment of time $t_2$. |

Then, in order to improve the efficiency of kinematic dressing, the zonal lapping is carried out on the assumption that the abrasion of the working surface of the lapping tools 4 in individual zones 5 is equal, i.e.

$$U_1 = U_2 = U_3 = \ldots = U_i = \ldots = U_n, \quad \text{(III)}$$

where: $i = 1, 2, 3, \ldots n$ is the number of the zone with in which the surfaces are lapped, either in successive or different combinations.

The claimed method of finishing which ensures uniformity of abrasion of the surfaces participating in the process can be used for machining the surface of a workpiece on the assumption of equality of the removed material from individual circular zones of the workpiece surface during one-sided or two-sided finishing by successive or continuous changes in the relative positions of the lapping tool and workpiece axles in the process of machining.

In this case the lapping tool and the workpiece come in contact on the individual zones of the workpiece which makes it possible to control the process of shaping the surface of the tool and workpiece.

The intensity of abrasion of the working surface of the tool (workpiece) is influenced by such factors of the process as:

$\nu$—velocity of the relative motion of the workpiece over the surface of the lapping tool (or of the tool over the workpiece);

$a^{\tau}$—tangential acceleration during relative motion of the workpiece over the surface of the tool (or of the tool over the workpiece);

p—specific pressure in the machining zone between the tool and the workpiece;

h—abrasive clearance between the workpiece and the tool;

T°—temperature in the machining zone.

Variations in the individual factors during machining or simultaneous changes of several factors change the intensity of abrasion of the material of the workpiece (lapping tool). The dependence of changes in the intensity of abrasion of the workpiece (Ko) and lapping tool (Kd) on the speed of the relative motion of the workpiece over the lapping tool ($\nu$), tangential acceleration ($a^{\tau}$) and contact pressure (p) has been proved experimentally by the values of Ko and Kd for silicon and ceramics.

It has also been found that the temperature exerts a certain effect on the properties of the nonabrasive component of the lapping compound and governs the temperature conditions of machining (see "Diamond-abrasive lapping of workpieces" by Orlov P. N. published by NII MACH, Moscow 1972) which influence the intensity of abrasion (K) of the material.

The physical basis of the claimed method is as follows:

An equilibrium strained state in the material of the workpiece and lapping tool during zonal lapping which is achieved by uniform distribution of the contact pressure in the zone of contact between the workpiece and the tool with simultaneous presence of all the parts in a certain zone within a single kinematic mode of a cycle.

Combination of zonal finishing at a single constant kinematic mode when the workpieces are being lapped with the entire working surface of the lapping tools with changes in the kinematic conditions within the limits of a cycle. This means that in finishing the workpieces with the entire surface of the lapping tools, one kinematic mode is changed to another within one machining cycle.

In this case there will be periodical changes in the equilibrium strained state of the material assessed by the magnitude of stresses and the density of microscopic cracks on changes in the kinematic modes.

One finishing cycle may comprise two or more kinematic modes characterized by the speed ratio i, B.

The transistion from the zonal finishing of parts to the lapping by the entire surface of the lapping tools can be carried out automatically with the aid of an eccentric mechanism (FIG. 4) which comprises a sectional eccentric shaft consisting of an eccentric drive shaft 6 whose eccentric axle 7 carries an intermediate planet pinion 8 meshing with the shaft 9 of the planetary mechanism and having an additional eccentric axle which serves as the axle 1 of the holder 2 with the workpiece finished by the lapping tools 4.

Further the additional eccentric axle will be indicated by numeral 1.

This design of the sectional eccentric shaft will permit the eccentricity "e" of the centre of rotation of the holder with workpiece relative to the centre of rotation of the lapping tools to be changed from zero to a maximum value "$e_{max}$" in the course of machining.

In the process of machining the workpieces may perform concentric motions relative to the centre of the working surfaces of the lapping tools combined periodically with the motions along the trajectories of epicycloids, hypocycloids and pericycloids in case of an eccentric setting of the machine (see "Diamond-abrasive lapping of workpieces" by P. N. Orlov, publ. by NIIMACH, 1972, Moscow).

The quality of the surface layer at variable speeds is impaired so that finishing should be carried out at a constant speed ($V_{const}$) of the workpiece motion over the surface of the lapping tool, which means that the movement should follow a circular trajectory while rough-machining should be performed at variable speeds ($V_{var}$) and variable tangential accelerations ($a^{\tau}$).

This method of finishing with periodical or constant changes in the amplitude of workpiece vibrations over the surface of the lapping tool will permit stabilization of the finishing process with regard to the accuracy of workpiece machining by keeping the shape of the lapping tool profile within the required range of out-of-planeness (for a flat lapping tool), out-of-sphericity (for a spherical lapping tool) and etc.

Besides, this method can be relied upon for machining workpieces by the zonal method, i.e. machining of their individual zones with the use of the same expressions and relationships of abrasion for successive removal of the material from the individual zones of the workpiece surface.

Thus, the invention consists in a method of finishing including cyclic and periodical changes of the angular and linear velocities of the elements of the machine operating mechanism in accordance with the law of abrasion of the working surfaces of the lapping tools and with the formula of distribution of mechanical work:

$$A = Kg \int_{t_1}^{t_2} \sqrt{R^2 \cdot \omega_{4c}^2 + r_B \cdot \omega_{Bc}^2 - 2R \cdot r_B \cdot \omega_{4c} \cdot \omega_{Bc} \cdot \cos(\omega_{4c} - \omega_{Bc})t} \cdot d \cdot t$$

where:

Kg—correction factor for the effect of dynamics of the finishing process;

R and rq—components of the vectorial calculation diagram determining the trajectory of the relative motion of the point of the lapping tool surface over the workpiece;

$W_{Bc}$—angular velocity of the lapping tool centre relative to the holder;

$W_{4c}$—angular velocity of the lapping tool relative to the holder;

$t_1$ and $t_2$—time of the beginning and end of contact of the lapping tool point with the workpiece.

Besides, the use is made of additional stage-by-stage changes of the velocity, tangential acceleration of the relative motion of the workpiece over the lapping tool, and pressure in the zone of contact between the workpiece and the lapping tool and alternating the sequence of these changes, the workpiece being first rough-machined with the velocity, tangential acceleration and pressure increased cyclically relative to their nominal values then the workpieces are finished with a cyclic increase in the velocity and a proportional reduction in the tangential acceleration.

The analysis of changes in these factors of the finishing process and their interaction with time makes it possible to create a controllable process of finishing both for one-sided and two-sided machining. If the efficiency of the process is regarded as a criterion of its optimization, then the interaction of the factors $v$, $a^{\tau}$ and p will have to ensure a maximum possible amount of removed material of the workpiece (intensity of abrasion). If the criterion of optimization of the process of finishing is the quality of the surface layer of the workpiece, then the interaction of the factors $v$, $a^{\tau}$, and P must ensure the required depth of the disturbed layer and the degree of disturbance therein.

The physical basis of the effect produced by the dynamism of loading of the system "workpiece—abrasive interlayer—lapping tool" on the factors of the finishing process is the change in the physical and mechanical properties of the surface layers of the workpiece and lapping tool at various relationships between pressure P, velocity V and acceleration $a^{\tau}$.

FIG. 1 shows an arbitrary trajectory of the relative motion of the workpiece 3 over the lapping tool 4, the type of said trajectory depending on the speed ratio $i_2b==n_2/n_b$ (relation of the holder speed $n_2$ to the speed of a notional pinion cage $n_b$).

A proportional change in the speeds $n_2$ and $n_b$ brings about a change in the average speed and acceleration of the relative motion of the workpiece 3 over the lapping tool 4, without changing the type of trajectory.

One and the same type of trajectory $a_b$, $a_1$, $a_2 \ldots a_n$ of the relative motion of the workpiece 3 over the lapping tool 4 in the form of an epicycloid may exist for two absolute values of V and $a^{\tau}$ at any moment of time (FIG. 3 a and b), which means that the workpiece moves along one and the same trajectory at various absolute values of V and $a^{\tau}$.

The absolute values of the velocity V and tangential acceleration $a^{\tau}$ of the relative motion of the workpiece 3 over the lapping tool 4 depend on the angular velocities of the elements of the operating mechanism of the finishing machine and can be found from the known formulas of theoretical mechanics.

Different susceptibility of the material of the workpiece and lapping tool to the effect and interaction of the factors V, $a^{\tau}$ and P, displayed first of all in the change of the structure of the layer disturbed by machining and the depth (thickness) of the zone covered with microscopic cracks and of the zone with elastic and plastic deformation depends on the properties of the system "workpiece-abrasive interlayer-lapping tool" and, in particular, on the degree of hardening or embrittlement of the surface layer of the workpiece and lapping tool.

By changing the velocity $v$, acceleration $a^{\tau}$ and pressure P cyclically according to a periodic or aperiodic law, it is possible to create a nonequilibrium strained state in the surface layer and thus to change the law of distribution of dislocations and other defects both in the depth of individual zones and throughout the entire depth of the surface layer.

The spreading of microscopic failure cracks of individual defects through the depth will depend on the amplitude and frequency characteristics of the acting variable stress in the surface layer which changes the nature and spreading speed of the failure cracks. The changes in V, $a^{\tau}$ and P bring about changes in the amount of mechanical work spent for abrading the materials of the lapping tool and workpiece. As a result, the efficiency and quality of finishing the workpieces made of brittle materials can be attained by combining their rough and finish machining in a single operation without replacing the lapping tool and changing the grain size of the abrasive material as has been practiced heretofore, but by following a certain sequence of changes in the velocity V, acceleration $a^{\tau}$ and pressure P and by alternating them in various combinations. For this purpose it is proposed during rough machining with a cyclic change of velocity V as practiced in the prior art method, to change simultaneously the acceleration $a^{\tau}$ and pressure P so that each increase in the velocity would correspond to a proportional increase in acceleration. $a^{\tau}$ and a reduction of 1.5–2 times in pressure and conversely, during finish machining when the velocity V is increased, this is accompanied by a proportional reduction in acceleration $a^{\tau}$ while pressure P is kept at one and the same level. In some cases one of the factors may be left unchanged.

The sequence of changes in velocity V, acceleration $a^{\tau}$ and pressure P. i.e. $V \rightarrow p \rightarrow a^{\tau}$ or $V \rightarrow a^{\tau} \rightarrow p$ or $V \rightarrow \rightarrow p \rightarrow V \rightarrow a^{\tau}$, etc., or $a^{\tau} \rightarrow p \rightarrow v$, or $p \rightarrow v \rightarrow a^{\tau}$, or $p \rightarrow a^{\tau} \rightarrow p$, or $a^{\tau}$—p—v, also the changes in their level ($v_1 v_2$—$p_2 \rightarrow p_2 \rightarrow a^{\tau}$ or $p_1 \rightarrow p_2 \rightarrow v_1 \rightarrow v_2 \rightarrow v_3$ etc.) make it possible to control the plasticity and brittleness, the value and law of changes of stresses in the surface layer of the workpiece and lapping tool in accordance with the properties of the system "workpiece—abrasive interlayer—lapping tool".

From the viewpoint of mechanics of failure of brittle materials in the process of finishing, each elementary act of making and separating chips of the material of the workpiece and lapping tool by an individual abrasive grain retains all the basic peculiarities of the process of failure, viz., an intensification of the mechanism of brittle failure of solid bodies with an increase in the dynamism of loading. In the course of finishing the dynamism of loading of the surface layer of the material being finished grows with the increase of the tangential acceleration $a^{\tau}$ of the relative motion of the workpiece over the lapping tool.

Thus, in order to increase the amount of removed material, it is required to create the conditions of nonmonotonic loading. Therefore, for stepping up the efficiency during rough machining, it is suggested to increase both the velocity and acceleration of the relative motion.

The pressure should be changed in the direction of its reduction at an increase in V and $a^{\tau}$. Elimination of all kinds of irregularities in the process of microscopic cutting is conducive to a reduction in the extent of destruction of the surface layer and in the depth of the defective layer with a large degree of heterogeneity of the strained state and the microscopic cracks of failure. Therefore, in the course of finish-machining of brittle materials calling for the provision of a high-quality surface layer, each cyclic change of velocity V in the known finishing process is suggested to be accompanied by an inverse change of acceleration $a^{\tau}$ with the pressure P remaining constant. Thus, by controlling constantly the velocity, acceleration and pressure in the course of machining with the use of kinematic dressing of the lapping tools of the machined surface of the workpiece, it appears possible to carry out both rough and finish machining of workpieces in a single operation which raises the efficiency of the process at the same time ensuring a high quality of the finished surfaces.

The use of the claimed method of finishing in the manufacture of ceramic supports has made it possible to increase the accuracy of shape of the spherical surfaces and to improve 1.5–2 times the wear resistance of the lot of ceramic supports.

Figure 4:
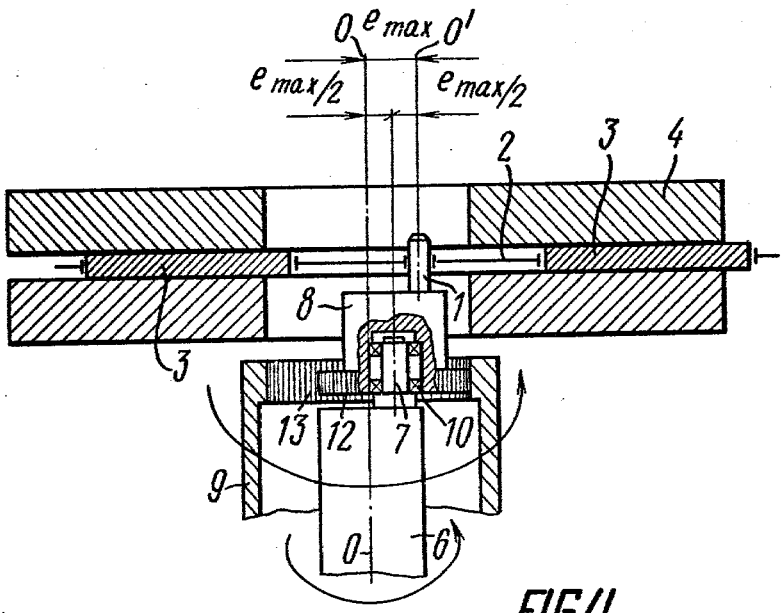
FIG. 4 is a longitudinal section of the eccentric machine according to the present invention which allows the eccentricity of the holder axle relative to the axle of the lapping tools to be changed in operation.

FIG. 4 shows diagrammatically the machine for surface-lapping workpieces with free abrasive in accordance with the above-described method.

This machine comprises an eccentric drive shaft 6 which carries an axle eccentric 7 arranged with an eccentricity of "$e_{max/2}$" with relation to the central axis 0—0. Mounted movably on said axle 7 with the aid of bearings 10 is an intermediate planet pinion 8 whose outer rim 12 is in mesh with the inner toothed rim 13 of a hollow shaft 9.

The intermediate planet pinion 8 carries an additional eccentric axle 1 installed with an eccentricity $e_{max/2}$ relative to its axle, the eccentric axle serving as the axle of the holder 2.

The holder 2 accommodates workpieces 3 which are located between the lapping tools 4.

The rotation drives of the eccentric shaft 6, shaft 9 and lapping tools 4 are not shown in the drawing.

The workpieces 3 are placed into the holder 2 and are machined or lapped between the lapping tools 4, moving along a complicated trajectory due to their eccentric motion and rotation around the additional eccentric axle 1.

In service the summary eccentricity "e" between the centre of the holder 2 and the centre of rotation of the lapping tools 4 can change from zero (0) to a maximum value ($e_{max}$) due to the use in the machine of a sectional eccentric shaft consisting of an eccentric drive shaft 6, an intermediate planet pinion 8 and the additional eccentric axle 1.

The machine functions as follows.

When the rotation speed of the eccentric drive shaft 6 is equal to that of the shaft 9 of the planetary mechanism, the intermediate planet pinion 8 does not rotate with relation to the eccentric axle 7 so that the axis $0^1$—$0^1$ rotates at a constant summary eccentricity "e" relative to the axis 0—0, said eccentricity being capable of ranging from zero to its maximum value depending on the initial position of the additional eccentric axle 1.

In case of mismatching of the rotation speeds of the shafts 6 and 9, the intermediate planet pinion 8 is rotated relative to the axle 7 which changes the summary eccentricity of the additional eccentric axle 1 relative to the central axis 0—0 with time.

At the moment when the position of the additional eccentric axle 1 coincides with the position of the central axis 0—0 (rotation radiuses of the axle 7 relative to the central axis 0—0 and of the additional eccentric axle 1 relative to the axle 7 being equal to each other and to "$e_{max/2}$"), the angular rotation speeds of the shafts 6 and 9 will be the same and the workpieces will move in the holder along circular trajectories over the surfaces of the lapping tools.

By varying the velocities of the eccentric drive shaft 6 and shaft 9 and the rotation speeds of the lapping tools 4 it is possible to obtain various trajectories of movement of the workpieces over the lapping tools, i.e. zonal machining of workpieces (machining of the workpieces within a certain zone of the lapping tools with a provision for extending the machining zone and shifting over to machining over the entire surface of the lapping tools), which ensures intensity of kinematic dressing of the lapping tools by the workpieces proper.

Figure 5:
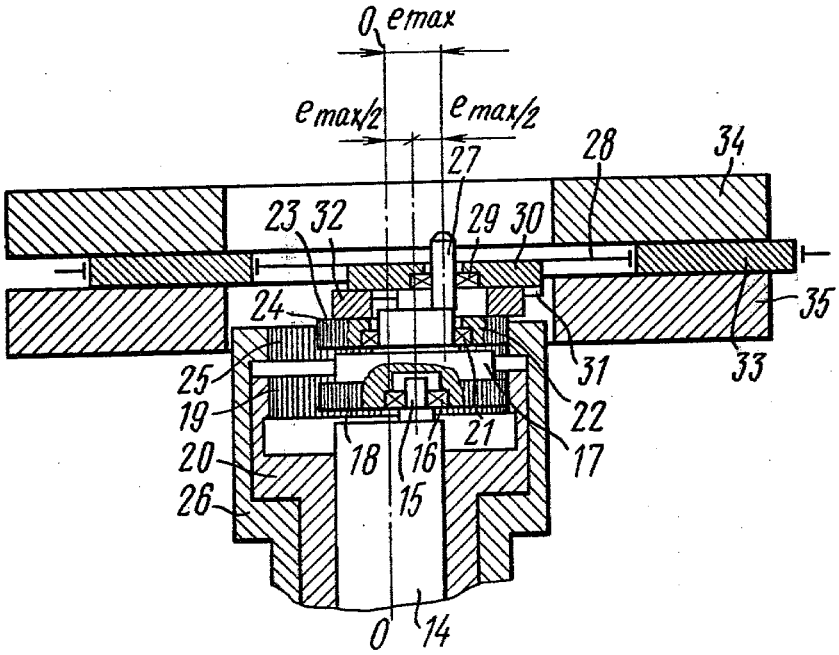
FIG. 5 is a fragmentary cross section view which shows the design of the eccentric machine according to the present invention which allows the eccentricity of the holder axle with relation to the lapping tool axle to be changed and the rotation speed of the holder around its axle to be controlled in operation.
Figures 6, 7:
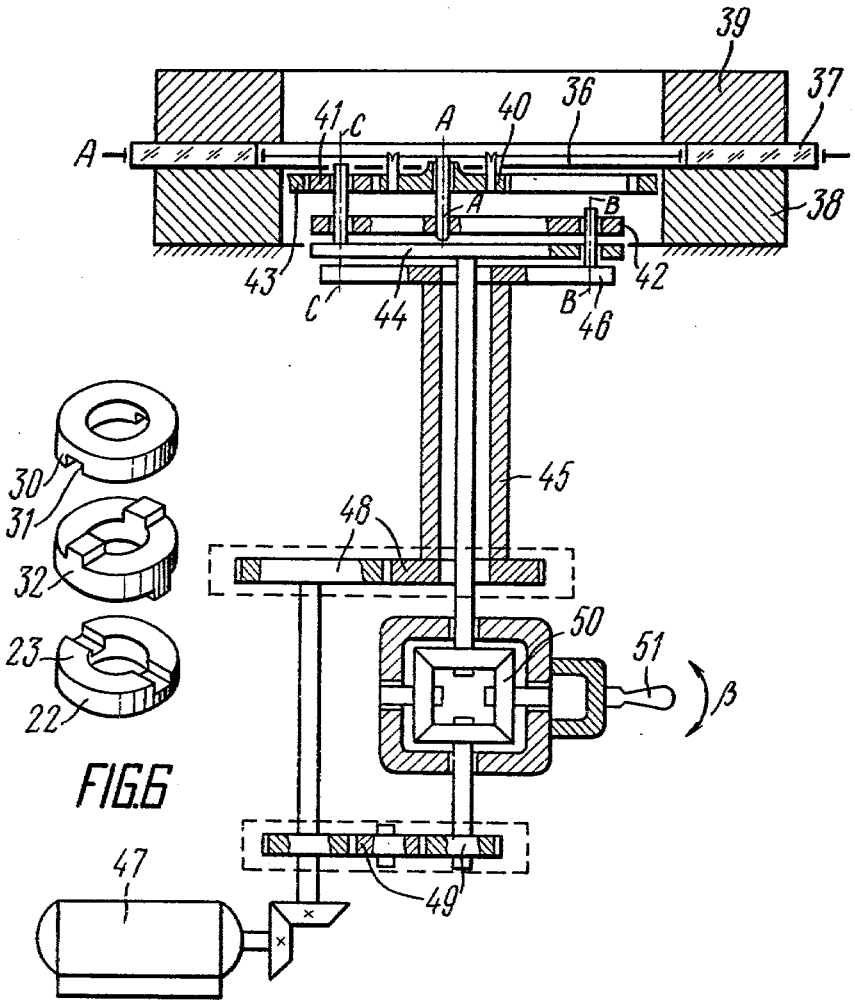
FIG. 6 is an exploded view which shows the design of the double-slider coupling used in the machine according to FIG. 5 which ensures transmission of rotation to the holder from an additional planetary mechanism.
FIG. 7 is a view in section which shows the design of the eccentric machine according to the present invention which allows the eccentricity of the holder axle to be changed with relation to the lapping tool axle and the rotation speed of the holder around its axle to be controlled in operation.

FIG. 5 shows a diagram of another embodiment of the machine for surface-lapping of workpieces and FIG. 6 shows the elements of the double-slider coupling of this machine.

The machine consists of an eccentric drive shaft 14 which carries an eccentric axle 15 arranged with an eccentricity of $e_{max/2}$ relative to the central axis 0—0. Mounted movably on said axle 15 with the aid of bearings 16 is a planet pinion 17 with a hub whose outer rim 18 meshes with the sun wheel 19 of a hollow shaft 20.

Installed with the aid of ball bearings 21 on the hub of the planet pinion 17, coaxially with it, is an additional planet pinion 22 whose upper end 23 constitutes a coupling member of a double-slider coupling.

The outer toothed rim 24 of the additional planet pinion 22 is in mesh with the inner toothed rim 25 of the spindle 26 which is set coaxially with the eccentric drive shaft 14 and the hollow shaft 20.

Mounted on the planet pinion 17 with an eccentricity $e_{max/2}$ relative to its axis is an additional eccentric axle 27 which serves as the axle of the holder 28.

The upper disc (coupling member) 30 of the double-slider coupling is installed with the aid of ball bearings 29 on the additional eccentric axle 27, said disc being connected rigidly with the holder 28. The lower face of the disc 30 is provided with a slot 31 receiving the projection of the coupling intermediate disc 32. At the opposite side the intermediate disc 32 has another projection which enters the slot in the lower disc of the double-slider coupling.

The holder 28 accommodates the workpieces 33 which are located between the lapping tools 34 and 35.

The rotation drives of the eccentric shaft 14, shaft 20, spindle 26 and lapping tools 34 and 35 are not shown in the drawing.

The machine operates as follows. The workpieces are inserted into the holder 28 and machined between the lapping tools 34 and 35, moving along a complicated trajectory owing to the eccentric motion and rotation around the eccentric 14.

In service the summary eccentricity can change from zero to a maximum.

When the speed of rotation of the eccentric drive shaft 14 is equal to that of the shaft 20, the planet pinion 17 does not rotate around the eccentric axle 15 so that the additional eccentric axle 27 rotates with a constant summary eccentricity relative to the central axis 0—0, said eccentricity varying from zero to its maximum value depending on the initial position of the additional eccentric axle 27.

When the rotation speeds of the drive eccentric shaft 14 and shaft 20 are mismatched, the planet pinion 17 starts rotating around the axle 15 which changes the summary eccentricity of the additional eccentric axle 27 relative to the central axis 0—0 with time.

At the instant when the position of the additional eccentric axle 27 coincides with that of the central axis 0—0, the angular rotation speeds of the shafts 14 and 20 are equalized and the workpieces 28 in the holder 28 will move along circular trajectories over the surfaces of the lapping tools 34 and 35.

Rotation is transmitted from the spindle 26 via the planetary drive to the lower disc of the double-slider coupling which comprises an intermediate disc 32 and an upper disc 30 rigidly connected with the holder 28 which is free-mounted on the additional eccentric axle 27.

When the rotation speed of the hollow shaft 20 is equal to that of the spindle 26, the additional planet pinion 12 does not receive additional rotation relative to the planet pinion 17, nor does the holder 28 around the additional eccentric axle 27.

When the rotation speeds of the shaft 20 and spindle 26 are mismatched, the holder 28 receives additional rotation around the additional eccentric axle 27.

By varying the rotation speeds of the eccentric drive shaft 14, hollow shaft 20, spindle 26 and of the lapping tools 34, 35 it is possible to obtain various trajectories of the workpieces 33 over the lapping tools, i.e. to carry out zonal machining of workpieces (machining them within a certain zone of the lapping tool) with a possibility of widening the machining zone and shifting over to machining over the entire surface of the lapping tools thereby ensuring intensity of kinematic dressing of the lapping tool surface by the workpieces proper.

Figure 8:
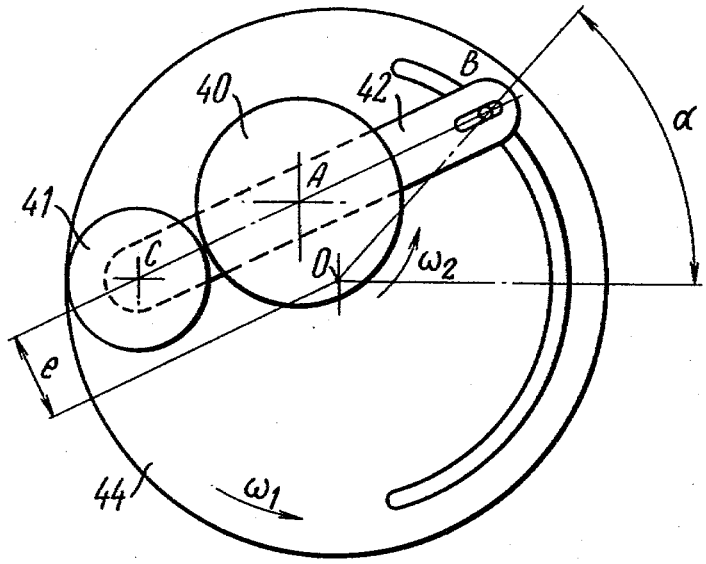
FIG. 8 is a top view of the operating mechanism of the holder drive in the machine shown in FIG. 7.

A diagram of the next design of the machine appears in FIG. 7 and the holder drive, in FIG. 8.

The machine comprises a holder 36 with workpieces 37 in sockets, said holder being located between two lapping tools 38 and 39 and secured on a gear 40 of the holder 36 meshing with an idler gear 41. The axle A—A of the holder gear 40 is connected with a carrier 42 which is free-mounted on the axle C—C of the idler gear 41.

The idler gear 41 meshes with the sun wheel 43 and is free-mounted on the axle C—C which is fixed on a pinion cage 44. The axle A—A rests on the pinion cage 44 and can turn together with the carrier 42 relative to the axle C—C.

The additional shaft 45 is provided with a disc 46 carrying an additional axle B—B which passes through an arc-shaped slot of the pinion cage 44 and enters into the slot of the carrier 42, thus forming a link motion between the additional shaft 45 and the carrier 42. The pinion cage 44 and the additional shaft 45 are moved by the drive 47 via the gear transmissions 48, 49 and a bevel gear differential 50. The differential housing can be turned about a vertical axis by a handle 51. The eccentricity "e" of the rotation axes of the holder gear and sun wheel is determined by the turning angle $\alpha$ of the additional shaft 45 relative to the pinion cage 44.

The machine functions as follows: the parts of the drive 47, 48, 49, 50 rotate the shaft 45 with the disc 46 and the pinion cage 44; the axle of the pinion cage 44 forces the idler gear 41 to roll around the sun wheel 43 and to rotate the holder gear 40 of the holder 36. The workpieces 37 located in the ports of the holder 36 are machined between the upper and lower lapping tools 39 and 38. The directions of the angular speeds $W_1$ and $W_2$ of the pinion cage 44 and the gear 40 of the holder 36 coincide. The angle $\alpha$ between the additional shaft 45 with the disc 46 and the pinion cage 44 is determined by the speed ratio of the idler gears 48 and 49 and by the turning angle $\beta$ of the housing of the differential 50. When the speed ratios of the elements 48 and 49 are 1:1, angle $\alpha$ is equal to angle $\beta$. Thus, on changes in angle $\beta$ the differential housing 50 turns the carrier 42 so that angle $\alpha$ and eccentricity "e" change in the course of machining of the workpieces 37.

This makes it possible to automate the process of finishing the workpieces and improve their quality since the use of this machine allows the finishing parameters to be controlled directly in the course of machining.

We claim:

1. A surface lapping machine for lapping workpieces by abrading thereof comprising, a workholder having sockets for holding workpieces therein to be lapped and an axis of rotation, two driven lapping tools between which the workholder is driven, a drive shaft, a hollow shaft, and a spindle each driven at variable speeds about an axis of rotation, a first planetary gear mechanism comprising a first planet pinion driven by said drive shaft and a first sun gear driven by said hollow shaft, and a second planetary gear mechanism having a second planet pinion and a second sun gear driven by said spindle, means mounting said second planet pinion on said first planet pinion of said first planetary gear mechanism, said workholder being eccentrically mounted on said second planet pinion for cummulatively developing a varying eccentricity of the axis of rotation of the workholder relative to the axis of rotation of said drive shaft.

2. A surface lapping machine for lapping workpieces by abrading thereof according to claim 1, including an additional eccentric axle driven along a path of eccentricity relative to the drive shaft for assisting cumulative development of said varying eccentricity.

* * * * *